US007585173B2

(12) United States Patent
Hilty et al.

(10) Patent No.: US 7,585,173 B2
(45) Date of Patent: Sep. 8, 2009

(54) ELASTOMERIC ELECTRICAL CONTACT

(75) Inventors: Robert D. Hilty, Harrisburg, PA (US); Matthew R. McAlonis, Elizabethtown, PA (US); George J. Chou, Mechanicsburg, PA (US); Dmitry Zhmurkin, Lower Paxton, PA (US); Jeffery W. Mason, North Attleboro, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/731,389

(22) Filed: Mar. 30, 2007

(65) Prior Publication Data

US 2008/0242128 A1 Oct. 2, 2008

(51) Int. Cl.
*H01R 12/00* (2006.01)

(52) U.S. Cl. ..... 439/66

(58) Field of Classification Search ..... 439/66, 439/91

See application file for complete search history.

(56) References Cited

U.S. PATENT DOCUMENTS 4,548,451 A 10/1985 Benarr et al.
5,427,535 A 6/1995 Sinclair
5,949,029 A 9/1999 Crotzer et al.
6,264,476 B1 7/2001 Li et al.
6,348,659 B1 2/2002 Crotzer et al.
6,948,940 B2 9/2005 Lindsey et al.
7,070,420 B1 7/2006 Wakefield et al.
2006/0105607 A1 5/2006 Hougham et al.
2007/0298626 A1 * 12/2007 Hougham et al. ..... 439/66

* cited by examiner

*Primary Examiner*—Ross N Gushi

(57) ABSTRACT

An electrical contact is provided that includes an elastomeric body extending between a base portion and a mating end portion. The elastomeric body includes a ledge extending from the mating end portion to the base portion of the elastomeric body. The ledge is defined by a portion of the elastomeric body. An electrically conductive pad extends over at least a portion of the mating end portion. An electrically conductive trace is formed on a surface of the ledge. The electrically conductive trace extends from the mating end portion to the base portion of the elastomeric body. The electrically conductive trace is in electrical contact with the electrically conductive pad for electrically connecting the electrically conductive pad with an electrically conductive element engaging the base portion of the elastomeric body.

18 Claims, 4 Drawing Sheets

ELASTOMERIC ELECTRICAL CONTACT

BACKGROUND OF THE INVENTION

The invention relates generally to electrical contacts, and more particularly, to elastomeric electrical contacts.

Interconnect devices are sometimes used to provide electrical connection between different electrical components, such as, but not limited to, integrated circuits and printed circuit boards, for example when removal, replacement, and/or testing of the electrical components is desired. Many of these electrical components have electrical contacts arranged in a "land grid array" (LGA) which is a two-dimensional array of contact pads. One type of interconnect device, known as an "interposer", has an array of compressible contacts which is placed between the two opposing arrays of the electrical components to provide an electrical connection between the electrical contacts of the opposing arrays.

Establishing reliable contact between the electrical contacts of the opposing electrical component arrays and the electrical contacts of the interposer may sometimes be difficult due to, for example, height variations between electrical contacts of the opposing electrical component arrays and/or the electrical contacts of the interposer. Variations in thickness and/or warping of any of the substrates supporting the opposing electrical contact arrays and the interposer may also cause difficulty establishing reliable contact. Many interconnect devices use elastomeric electrical contacts that are compressed between the electrical contacts of the opposing electrical component arrays such that the elastomeric electrical contacts apply a mechanical force to the electrical contacts to facilitate establishing and maintaining reliable electrical contact between the opposing electrical component arrays. Compression of the elastomeric electrical contacts also allows for some degree of nonplanarity between, and/or misalignment of, the electrical contacts of the opposing electrical component arrays that may be caused by the warping, variations of height, and/or variations of thickness described above.

Elastomeric electrical contacts typically include an elastomeric body and electrically conducting pathway. Some known elastomeric electrical contacts, sometimes referred to as "filled elastomers", include an elastomeric body having an interior that is filled with one or more electrically conducting materials. However, filled elastomers may have a limited elastic working range because of the amount of conducting filler needed to reach the percolation threshold and conduct a predetermined amount of electrical current, which may increase contact forces above desired levels. Other known elastomeric electrical contacts include an elastomeric body that includes an electrically conductive pathway formed on an exterior of the elastomeric body. Elastomeric electrical contacts having an electrically conductive pathway on an exterior thereof may have a higher elastic working range than filled elastomeric electrical contacts. However, the electrically conductive pathway may have a lower current carrying capability than filled elastomeric electrical contacts. For example, the dimensions of the electrically conductive pathway may be limited by the desired elastic working range of the elastomeric body. Specifically, if the electrically conductive pathway is formed too large, it may limit the elastic working range of the elastomeric body or the electrically conductive pathway. However, if the conductive pathway is formed too small, it may not carry a desired level of electrical current. Moreover, if formed too small, the conductive pathway may crack and/or fracture during compression of the elastomeric body such that the electrical circuit is broken.

What is needed therefore is an elastomeric electrical contact that has a higher current carrying capability than known elastomeric electrical contacts having exterior electrically conductive pathways while maintaining a predetermined elastic working range without cracking and/or fracture of the pathway.

BRIEF DESCRIPTION OF THE INVENTION

In one embodiment, an electrical contact is provided that includes an elastomeric body extending between a base portion and a mating end portion. The elastomeric body includes a ledge extending from the mating end portion to the base portion of the elastomeric body. The ledge is defined by a portion of the elastomeric body. An electrically conductive pad extends over at least a portion of the mating end portion. An electrically conductive trace is formed on a surface of the ledge. The electrically conductive trace extends from the mating end portion to the base portion of the elastomeric body. The electrically conductive trace is in electrical contact with the electrically conductive pad for electrically connecting the electrically conductive pad with an electrically conductive element engaging the base portion of the elastomeric body.

In another embodiment, an interposer for electrically connecting a pair of electrical components is provided. The interposer includes a substrate including an electrically conductive element, and an electrical contact mounted on the substrate. The electrical contact includes a first elastomeric portion having a first mating end portion and a first ledge. The first ledge is defined by a portion of the first elastomeric portion. A second elastomeric portion has a second mating end portion and a second ledge. The second ledge is defined by a portion of the second elastomeric portion. First and second electrically conductive pads extend over at least a portion of the first and second mating end portions, respectively. First and second electrically conductive traces are formed on a surface of the first and second ledges, respectively. The first electrically conductive trace is in electrical contact with the first electrically conductive pad and the electrically conductive element. The second electrically conductive trace is in electrical contact with the second electrically conductive pad and the electrically conductive element such that the first and second electrically conductive pads are electrically connected.

In another embodiment, an electrical contact is provided that includes an elastomeric body extending between a base portion and a mating end portion, an electrically conductive pad extending over at least a portion of the mating end portion, the electrically conductive pad comprising a generally planar portion, and an electrically conductive trace formed on an exterior surface of the elastomeric body. The electrically conductive trace extends from the mating end portion to the base portion of the elastomeric body. An exposed surface of the electrically conductive trace faces in a direction generally toward the plane of the generally planar portion of the electrically conductive pad. The electrically conductive trace being in electrical contact with the electrically conductive pad for electrically connecting the electrically conductive pad with a conductive element engaging the base portion of the elastomeric body.

DETAILED DESCRIPTION OF THE INVENTION

Figure 1:
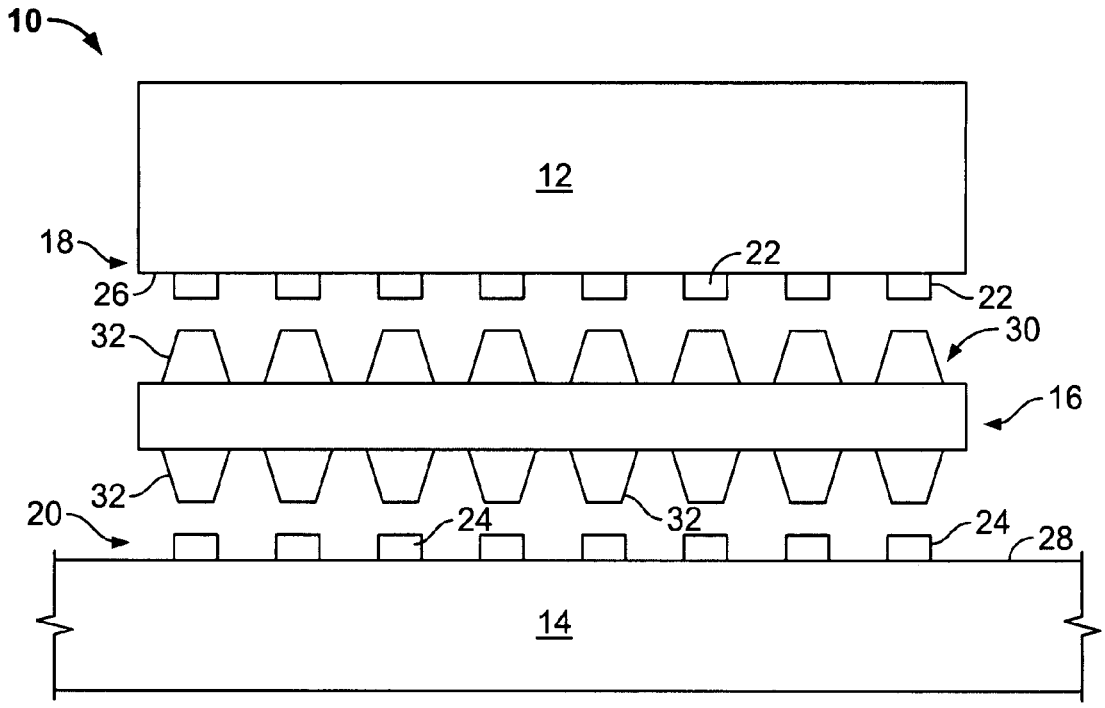
FIG. 1 is a front elevation exploded view of an electrical component assembly formed in accordance with an embodiment of the present invention.

FIG. 1 is a front elevation exploded view of an electrical component assembly 10 formed in accordance with an embodiment of the present invention. The assembly 10 includes a pair of electrical components 12, 14, and an interposer 16 for electrically connecting the electrical components 12, 14. The electrical components 12, 14 each include a respective array 18, 20 of a plurality of electrical contacts 22, 24 on opposing surfaces 26, 28 thereof, respectively. The array 18 of the electrical component 12 substantially matches the pattern of the array 20 of the electrical component 14. The interposer 16 includes an array 30 of a plurality of elastomeric electrical contacts 32 for electrically connecting the arrays 18, 20 of the electrical components 12, 14. The array 30 of the interposer 16 substantially matches the pattern of the arrays 18, 20 of the electrical components 12, 14, respectively.

The electrical components 12, 14 may each be any suitable type of electrical component, such as, but not limited to, printed circuit boards, integrated circuits, electrical modules, and/or other electrical devices. The arrays 18, 20 may each be any suitable type of array of electrical contacts that enables operative electrical connection between the electrical components 12, 14, such as, but not limited to, Pin Grid Arrays (PGAs), Land Grid Arrays (LGAs), and/or Ball Grid Arrays (BGAs). Moreover, the arrays 18, 20 may have any suitable configuration, arrangement, and/or pattern of electrical contacts that enables operative electrical connection between the electrical components 12, 14.

Figure 2:
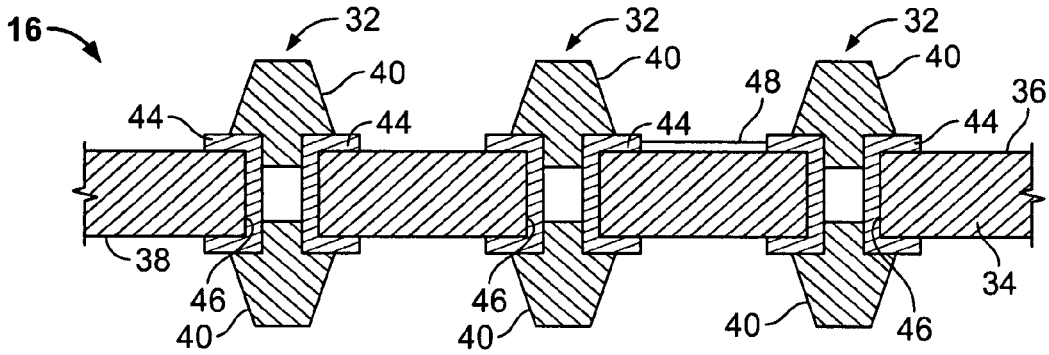
FIG. 2 is a cross-sectional view of a portion of an interposer shown in FIG. 1 formed in accordance with an embodiment of the present invention.

FIG. 2 is a cross-sectional view of a portion of the interposer 16 formed in accordance with an embodiment of the present invention. The interposer 16 includes a substrate 34 that supports the elastomeric electrical contacts 32 and includes opposite surfaces 36, 38. The elastomeric electrical contacts 32 each include two substantially identical portions 40 each located on one of the opposite surfaces 36, 38 of the substrate 34. As will be described in more detail below, the two portions 40 of each electrical contact 32 are electrically connected via a conducting element 44. In the exemplary embodiment, the substrate 34 includes a plurality of through holes 46 that are each coated with the conductive element 44 such that the conductive element 44 extends about at least a portion of a circumference of the corresponding through hole 46. Optionally, some or all of the coated through holes 46 are grounded using any suitable means, such as, but not limited to, ground traces 48 on the substrate 34. The holes 46 are arranged in a pattern that substantially matches the pattern of each of the electrical contact arrays 18, 20 (shown in FIG. 1) of the electrical components 12, 14 (shown in FIG. 1), respectively. In the exemplary embodiment, the elastomeric electrical contact portions 40 are partially received within the corresponding through holes 46 to facilitate fastening the portions 40 to the substrate 34 and aligning each portion 40 with the pattern of its corresponding array 18, 20. Additionally or alternatively, each elastomeric electrical contact portion 40 may be fastened to the substrate 34 using any suitable fastener, such as, but not limited to, an adhesive. The two substantially identical portions 40 located on the opposite surfaces 36, 38 of the substrate 34 may optionally be connected together at base portions 52 (shown in FIG. 3) thereof such that the opposite portions 40 form an integral structure extending completely through the corresponding through hole 46, whether the portions 40 are formed integrally or attached together.

Alternatively, the substrate 34 and the electrically conductive elements 44 may have other arrangements and/or configurations besides coated through holes that enable the conductive elements 44 to electrically connect the portions 40 of each elastomeric electrical contact 32. Moreover, although shown as extending over the surfaces 36, 38, the conductive elements 44 may only extend over interior surfaces of the substrate that define the through holes 46.

The conductive elements 44 may be fabricated from any suitable material(s) that enable the conductive elements 44 to function as described herein, such as, but not limited to, copper, aluminum, silver, nickel, palladium, platinum, rhodium, rhenium, tin, and/or gold. Non-noble metals covered with a conductive layer may be used as a base material(s) to provide strength and/or rigidity. Such non-noble metals may be covered with a barrier metal that is covered with a surface structure of a noble metal to ensure chemical inertness and provide suitable asperity distribution to facilitate good metal-to-metal contact. The substrate 34 may be fabricated from any suitable material(s) that enables the substrate 34 to function as described herein, such as, but not limited to polyimide, polyester, epoxy, other materials having a low and uniform dielectric constant, and/or electrically conductive materials, such as, but not limited to, stainless steel. In some embodiments, the substrate 34 is fabricated entirely from one or more materials having a low and uniform dielectric constant (excluding any conducting elements, traces, and the like, e.g., the elements 44 and the traces 48). Alternatively, the substrate 34 is fabricated from one or more conductive materials, such as, but not limited to, stainless steel, that is at least partially covered with one or more materials having a low and uniform dielectric constant. The dielectric properties of the substrate 34 facilitate shielding the electrical contacts 32 from each other. Additionally or alternatively, each electrical contact portion 40 may be at least partially covered by one or more shielding layers of any suitable material(s).

Figure 3:
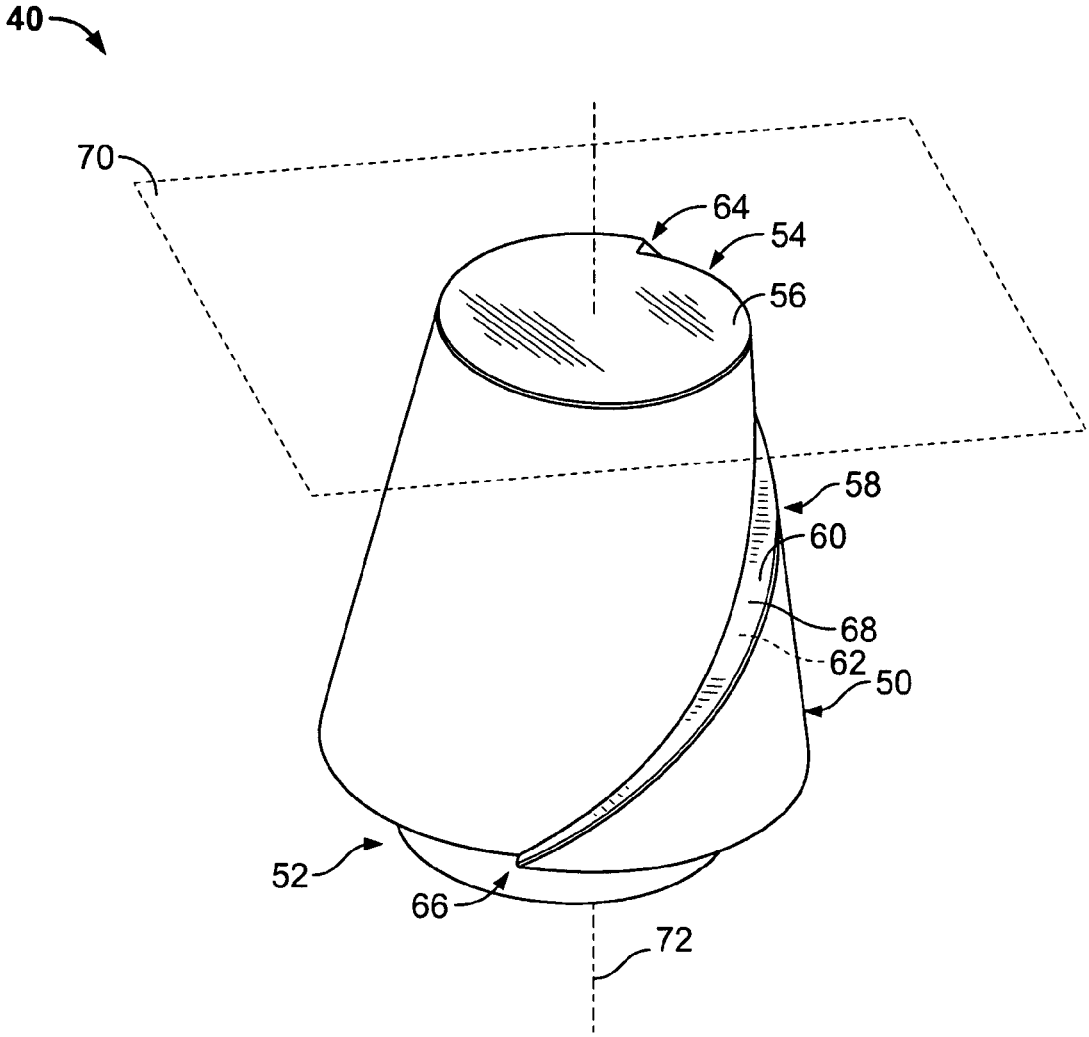
FIG. 3 is a perspective view of a portion of an elastomeric electrical contact shown in FIGS. 1 and 2 formed in accordance with an embodiment of the present invention.

FIG. 3 is a perspective view of a portion 40 of an elastomeric electrical contact 32 formed in accordance with an embodiment of the present invention. Each portion 40 of each elastomeric electrical contact 32 is substantially identical, except for their locations on the corresponding surface 36, 38 (shown in FIG. 2) of the substrate 34 (shown in FIG. 2). For clarity, only one portion 40 of an elastomeric electrical contact 32 is shown in FIG. 3. The elastomeric electrical contact portion 40 includes an elastomeric body 50 extending from a base portion 52 to a mating end portion 54. Each base portion 52 engages a corresponding conductive element 44 on the substrate 34, as is shown in FIG. 2. In the exemplary embodiment, each base portion 52 is partially received in a corresponding through hole 46 (shown in FIG. 2) of the substrate 34. The elastomeric bodies 50 are compressible such that they apply a mechanical force to the electrical contacts 22, 24 (shown in FIG. 1) of the arrays 18, 20 (shown in FIG. 1), respectively, when the electrical components 12, 14 are mechanically connected together.

An electrically conductive pad 56 extends over the mating end portion 54 of the elastomeric body 50. The pad 56 engages a corresponding electrical contact 22, 24 of the corresponding array 18, 20, respectively, to electrically connect the electrical contacts 22, 24 with the corresponding electrical contact 32, as will be described below in more detail. The electrically conductive pad 56 may also facilitate preventing siloxane contamination at the interface of the pad 56 and the corresponding electrical contact 22, 24. Although shown as generally planar, the electrically conductive pad 56 may have any suitable shape, whether completely or partially planar, and may cover any portion of the mating end portion 54 of the elastomeric body 50 that enables the conductive pad 56 to function as described herein.

The elastomeric body 50 includes a ledge 58 extending about an exterior thereof. The ledge 58 extends from the mating end portion 54 to the base portion 52 of the elastomeric body 50. An electrically conductive trace 60 is formed on a surface 62 of the ledge 58. The electrically conductive trace 60 extends from the mating end portion 54 to the base portion 52 of the elastomeric body 50. The electrically conductive trace 60 is in electrical contact with the electrically conductive pad 56 at an end 64 thereof. An opposite end 66 of the electrically conductive trace 60 is positioned such that when the base portion 52 of the elastomeric body 50 is engaged with the corresponding conductive element 44, the conductive trace 60 is in electrical contact with the corresponding conductive element 44. Accordingly, when the base portion 52 is engaged with the corresponding conductive element 44, the electrically conductive pad 56 is electrically connected to its corresponding conductive element 44 via the electrically conductive trace 60. The size of the electrically conductive trace 60 may be selected to provide a predetermined current carrying capability as well as provide sufficient support for the trace 60 such that the trace 60 does not crack and/or fracture for a predetermined elastic working range of the elastomeric body 50.

The ledge 58 and the electrically conductive trace 60 may each have any suitable shape and follow any suitable path about the elastomeric body 50 that enables them to function as described herein. In the exemplary embodiment, the ledge 58 and the trace 60 each extend in a generally helical path about the elastomeric body 50. Moreover, in the exemplary embodiment, an exposed surface 68 of the trace 60 faces in a direction generally toward a plane 70 of the generally planar electrically conductive pad 56. The plane 70 of the electrically conductive pad 56 extends, in the exemplary embodiment, generally perpendicularly to a longitudinal axis 72 of the elastomeric body 50. However, in embodiments where the electrically conductive pad 56 does not define a plane that extends generally perpendicularly to the longitudinal axis 72, the trace 60 may face in a direction generally toward a plane (not shown) that extends generally perpendicularly to the longitudinal axis 72.

The electrically conductive trace 60 may be formed on the ledge 58 using any suitable means, method(s), and/or process (es), such as, but not limited to, electroplating, physical vapor deposition, evaporation, sputtering, chemical vapor deposition, and/or direct metal printing. The electrically conductive trace 60 may be fabricated from any suitable material(s) that enable the trace 60 to function as described herein, such as, but not limited to, copper, aluminum, silver, nickel, palladium, platinum, rhodium, rhenium, tin, and/or gold. Non-noble metals covered with a conductive layer may be used as a base material(s) to provide strength and/or rigidity. Such non-noble metals may be covered with a barrier metal that is covered with a surface structure of a noble metal to ensure chemical inertness and provide suitable asperity distribution to facilitate good metal-to-metal contact.

The conductive pad 56 may be fabricated from any suitable material(s) that enable the conductive pad 56 to function as described herein, such as, but not limited to, copper, aluminum, silver, nickel, palladium, platinum, rhodium, rhenium, tin, and/or gold. Non-noble metals covered with a conductive layer may be used as a base material(s) to provide strength and/or rigidity. Such non-noble metals may be covered with a barrier metal that is covered with a surface structure of a noble metal to ensure chemical inertness and provide suitable asperity distribution to facilitate good metal-to-metal contact.

The elastomeric body 50 may be fabricated from any suitable material(s) that enable the elastomeric body 50 to function as described herein, such as, but not limited to, silicone rubber, fluorosilicone rubber, polyepoxide, polyimide, polybutadiene, neoprene, ethylene propylene diene monomer (EPDM), a thermoplastic elastomer, and/or polystyrene. The elastomeric body 50 may have any suitable shape that enables the elastomeric body 50 to function as described herein, such as, but not limited to, a cone, a truncated cone (a frustoconical shape), a pyramid, a truncated pyramid, a prism, and/or a hemisphere. In the exemplary embodiment, the elastomeric body 50 includes a frustoconical shape extending between the mating end portion 54 and the base portion 52.

Figure 4:
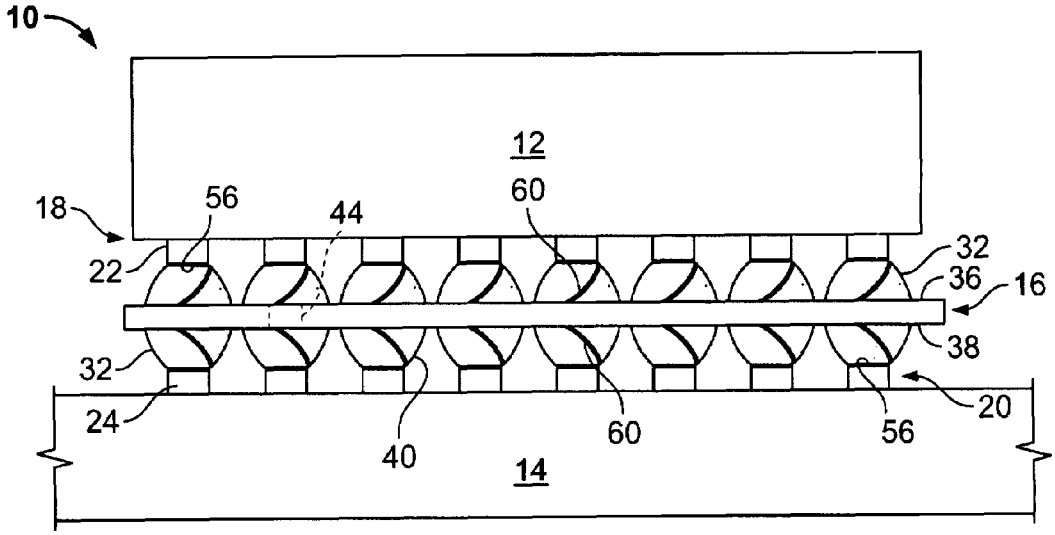
FIG. 4 is a front elevation view of the electrical component assembly shown in FIG. 1.

FIG. 4 is a front elevation view of the electrical component assembly 10. In operation, the interposer 16 is positioned between, and aligned with the electrical components 12, 14. When the electrical components 12, 14 are mechanically connected together, the elastomeric electrical contacts 32 of the interposer 16 electrically connect each electrical contact 22 of the array 18 with its corresponding electrical contact 24 of the array 20. Specifically, each electrically conductive pad 56 of the elastomeric electrical contact portions 40 located on the surface 36 of the interposer substrate 34 is in electrical contact with its corresponding electrical contact 22 of the array 18 of the electrical component 12. Each electrically conductive trace 60 of the elastomeric electrical contact portions 40 located on the substrate surface 36 electrically connects its corresponding pad 56 to the corresponding conductive element 44. The conductive elements 44 are also electrically connected to the electrically conductive traces 60 of the elastomeric electrical contact portions 40 located on the substrate surface 38. The elastomeric electrical contact portions 40 located on the substrate surface 38 are electrically connected to their corresponding electrically conductive pads 56, which are engaged with, and therefore electrically connected to, the corresponding electrical contact 24 of the array 20 of the electrical component 14 to complete the electrical connection between the electrical components 12, 14. When the electrical components 12, 14 are mechanically connected together as shown in FIG. 4, the elastomeric electrical contacts 32 of the interposer 16 are compressed between the opposing arrays 18, 20 and therefore apply a mechanical force to the electrical contacts 22, 24 of the arrays 18, 20, respectively, to facilitate establishing and maintaining reliable electrical contact between the arrays 18, 20. The elastomeric properties of the electrical contacts 32 also allow for some degree of nonplanarity between, and/or misalignment of, the electrical components 12, 14.

Figure 5:
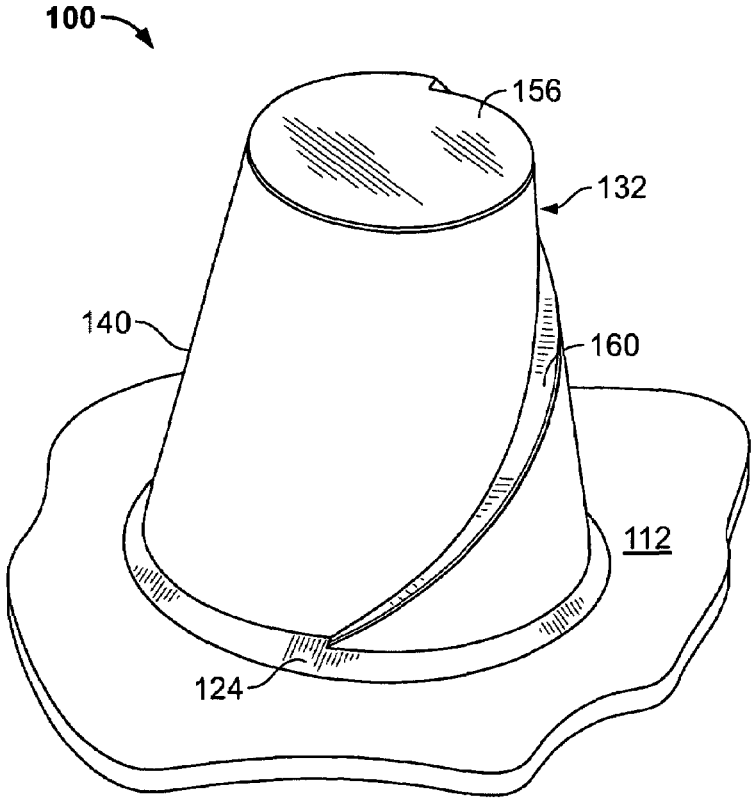
FIG. 5 is a perspective view of an electrical component assembly formed in accordance with an alternative embodiment of the present invention.

FIG. 5 is a perspective view of a portion of an electrical component assembly 100 formed in accordance with an alternative embodiment of the present invention. Although the elastomeric electrical contacts 32 are shown in FIGS. 1-4 as including two identical portions 40 (shown in FIGS. 1, 2, and 4) on opposite sides of an interposer substrate 34 (shown in FIGS. 1, 2, and 4), embodiments of the elastomeric electrical contacts of the present invention are not limited to such an arrangement. Rather, embodiments of elastomeric electrical contacts formed in accordance with the present invention may be used without an interposer, and/or with only one or more than two portions. For example, FIG. 5 illustrates an alternative embodiment of an elastomeric electrical contact 132 for electrically connecting an electrical component 112 with another electrical component (not shown). The elastomeric electrical contact 132 is substantially similar to the contacts 32 except the contact 132 includes only one portion 140 and is not configured for use as a portion of an interposer. Specifically, the contact 132 is mounted directly on the electrical component 112 such that an electrically conductive trace 160 is in electrical contact with an electrical contact 124 of the electrical component 112. The trace 160 is also electrically connected to an electrically conductive pad 156 that is configured to engage and electrically connect to an electrical contact (not shown) on the other electrical component.

Figure 6:
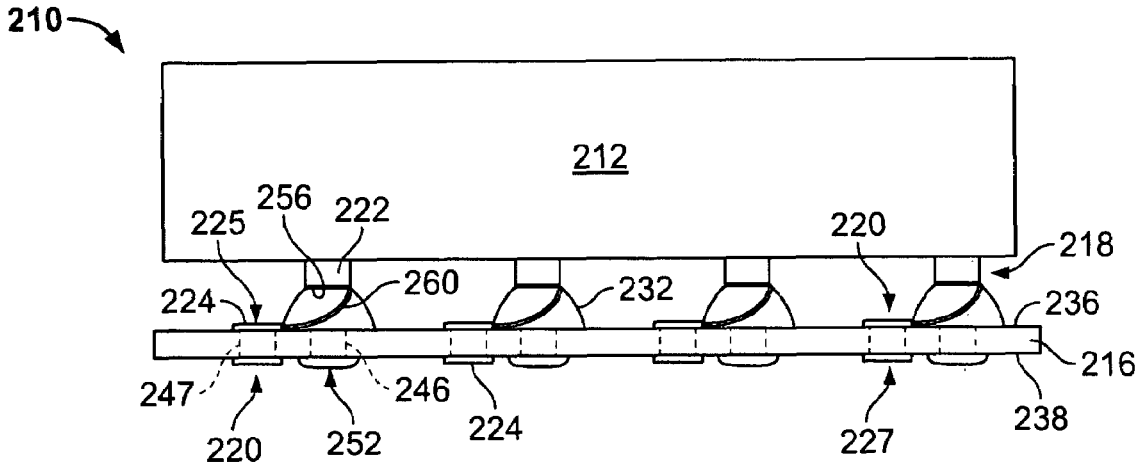
FIG. 6 is a front elevation view of an electrical component assembly formed in accordance with another alternative embodiment of the present invention.

FIG. 6 is a front elevation view of an electrical component assembly 210 formed in accordance with another alternative embodiment of the present invention. The assembly 210 includes an electrical component 212, a circuit board 216, and a plurality of elastomeric electrical contacts 232 that electrically connect the electrical component 212 to the circuit board 216. The electrical component 212 and the circuit board 216 each include a respective array 218, 220 of a plurality of respective electrical contacts 222, 224. The arrays 218, 220 may each be any suitable type of array of electrical contacts that enables operative electrical connection between the electrical component 212 and the circuit board 216, such as, but not limited to, Pin Grid Arrays (PGAs), Land Grid Arrays (LGAs), and/or Ball Grid Arrays (BGAs). Moreover, the arrays 218, 220 may have any suitable configuration, arrangement, and/or pattern of electrical contacts that enables operative electrical connection between the electrical component 212 and the circuit board 216.

In the exemplary embodiment, each of the electrical contacts 224 of the circuit board 216 extends through a corresponding through hole 247 within the circuit board 216 such that each contact 224 includes a portion 225 extending along a surface 236 of the circuit board and a portion 227 extending along an opposite surface 238 of the circuit board 216. The elastomeric electrical contacts 232 are mounted directly on the circuit board 216 such that an electrically conductive trace 260 of each contact 232 is in electrical contact with the portion 225 of a corresponding one of the electrical contacts 224 of the circuit board 216. Each trace 260 is also electrically connected to an electrically conductive pad 256 of the contact 232 that is engaged with, and therefore electrically connected to, a corresponding one of the electrical contacts 222 of the electrical component 212. The portions 227 of each of the electrical contacts 224 of the circuit board 216 may be electrically connected to corresponding electrical contacts (not shown) of any other suitable electrical component (not shown), such as, but not limited to, another circuit board, integrated circuits, electrical modules, and/or other electrical devices. Optionally, the elastomeric electrical contacts 232 may each extend through a through hole 246 within the circuit board 216 and include a base portion 252 extending along the surface 238 of the circuit board 216. The base portion 252 may facilitate stabilizing and/or facilitate holding the elastomeric electrical contacts 232 on the circuit board 216.

The embodiments described herein provide an elastomeric electrical contact that may reduce a stress applied to an electrically conductive trace during compression of an elastomeric body of the contact.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. For example, although specific sensor elements are described and/or illustrated with specific attachment devices, each described and/or illustrated sensor element may be used with any of the described and/or illustrated attachment devices as is appropriate. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical contact comprising:

an elastomeric body extending between a base portion and a mating end portion, the elastomeric body comprising a surface extending from the mating end, portion to the base portion, a portion of the surface being offset from another portion of the surface to define a ledge extending from the mating end portion to the base portion of the elastomeric body, the ledge being defined by a portion of the elastomeric body;

an electrically conductive pad extending over at least a portion of the mating end portion; and an electrically conductive trace formed on a surface of the ledge, the electrically conductive trace extending from the mating end portion to the base portion of the elastomeric body, the electrically conductive trace being in electrical contact with the electrically conductive pad for electrically connecting the electrically conductive pad with an electrically conductive element engaging the base portion of the elastomeric body.

2. The electrical contact according to claim 1, wherein the elastomeric body includes a central longitudinal axis extending from the base portion to the mating end portion, an exposed surface of the electrically conductive trace facing in a direction generally toward a plane that extends generally perpendicularly to the longitudinal axis of the elastomeric body.

3. The electrical contact according to claim 1, wherein the electrically conductive pad comprising a generally planar portion, an exposed surface of the electrically conductive trace facing in a direction generally toward a plane of the generally planar portion of the electrically conductive pad.

4. The electrical contact according to claim 1, wherein the ledge and the electrically conductive trace each extend between the base portion and the mating end portion of the elastomeric body in a generally helical path about the elastomeric body.

5. The electrical contact according to claim 1, wherein the elastomeric body comprises a shape extending between the mating end portion and the base portion of one of a cone, a truncated cone, a pyramid, a truncated pyramid, a prism, and a hemisphere.

6. The electrical contact according to claim 1, wherein the elastomeric body comprises at least one of silicone rubber, flourosilicone rubber, polyepoxide, polyimide, polybutadiene, neoprene, ethylene propylene diene monomer (EPDM), a thermoplastic elastomer, and polystyrene.

7. The electrical contact according to claim 1, wherein the electrically conductive pad comprises at least one of copper, aluminum, silver, nickel, palladium, platinum, rhodium, rhenium, tin, and/or gold.

8. The electrical contact according to claim 1, wherein the electrically conductive trace comprises at least one of copper, aluminum, silver, nickel, palladium, platinum, rhodium, rhenium, tin, and/or gold.

9. The electrical contact according to claim 1, wherein the elastomeric body comprises a base portion that is dimensioned smaller than at least some other portions of the elastomeric body and is configured to be received within a through hole of a substrate.

10. An interposer for electrically connecting a pair of electrical components, said interposer comprising:

a substrate comprising an electrically conductive element; and an electrical contact mounted on the substrate, the electrical contact comprising:

a first elastomeric portion having a first mating end portion and a first ledge, the first ledge being defined by a portion of the first elastomeric portion and extending in a generally helical path about the first elastomeric portion;

a second elastomeric portion having a second mating end portion and a secondledge, the second ledge being defined by a portion of the second elastomeric portion and extending in a generally helical path about the second elastomeric portion;

first and second electrically conductive pads extending over at least a portion ofthe first and second mating end portions, respectively; and first and second electrically conductive traces formed on a surface of the first andsecond ledges, respectively, the first electrically conductive trace being in electrical contact with the first electrically conductive pad and the electrically conductive element, the second electrically conductive trace being in electrical contact with the second electrically conductive pad and the electrically conductive element such that the first and second electrically conductive pads are electrically connected.

11. The interposer according to claim 10, wherein the substrate comprises a through hole, the electrically conductive element extending about at least a portion of a circumference of the through hole.

12. The interposer according to claim 11, wherein each of the first and second elastomeric portions are partially received within the through hole.

13. The interposer according to claim 10, wherein the first elastomeric portion includes a central longitudinal axis extending therethrough from the first mating end portion to a base portion of the first elastomeric portion, an exposed surface of the first electrically conductive trace facing in a direction generally toward a plane that extends generally perpendicularly to the longitudinal axis of the first elastomeric portion adjacent the first mating end portion.

14. The interposer according to claim 10, wherein the first electrically conductive pad comprises a generally planar portion, an exposed surface of the first electrically conductive trace facing in a direction generally toward a plane of the generally planar portion of the first electrically conductive pad.

15. The interposer according to claim 10, wherein the first and second elastomeric portions each comprise a shape of one of a cone, a truncated cone, a pyramid, a truncated pyramid, a prism, and a hemisphere.

16. The interposer according to claim 10, wherein the first and second elastomeric portions each comprise at least one of silicone rubber, flourosilicone rubber, polyepoxide, polyimide, polybutadiene, neoprene, ethylene propylene diene monomer (EPDM), a thermoplastic elastomer, and polystyrene.

17. The interposer according to claim 10, wherein the first and second elastomeric portions extend outwardly from opposite sides of the substrate.

18. An electrical contact comprising:

an elastomeric body extending between a base portion and a mating end portion, the elastomeric body comprising a ledge defined by a portion of the elastomeric body, the ledge extending along a generally helical path about the elastomeric body;

an electrically conductive pad extending over at least a portion of the mating end portion; and an electrically conductive trace formed on a surface of the ledge, the electrically conductive trace extending from the mating end portion to the base portion of the elastomeric body, the electrically conductive trace being in electrical contact with the electrically conductive pad for electrically connecting the electrically conductive pad with a conductive element engaging the base portion of the elastomeric body.

* * * * *